United States Patent [19]

Bauermeister

[11] Patent Number: 4,817,409

[45] Date of Patent: Apr. 4, 1989

[54] APPARATUS FOR FLANGING AND INDENTING BOTH ENDS OF A CYLINDRICAL CONTAINER BODY

[75] Inventor: Kurt Bauermeister, Braunschweig, Fed. Rep. of Germany

[73] Assignee: Lanico-Maschinenbau Otto Niemsch Gesellschaft Mit Beschrankter Haftung, Braunschweig, Fed. Rep. of Germany

[21] Appl. No.: 74,766

[22] Filed: Jul. 17, 1987

[30] Foreign Application Priority Data

Jul. 19, 1986 [DE] Fed. Rep. of Germany ..... 3624444

[51] Int. Cl.[4] ..... B21D 19/06

[52] U.S. Cl. ..... 72/94; 72/110

[58] Field of Search ..... 72/94, 106, 110

[56] References Cited

U.S. PATENT DOCUMENTS

| | | | |
|---|---|---|---|
| 2,114,272 | 4/1938 | Temple | 72/94 |
| 3,483,722 | 12/1969 | Fink | 72/94 |
| 3,688,538 | 9/1972 | Hoyne | 72/94 |

FOREIGN PATENT DOCUMENTS

| | | |
|---|---|---|
| 2321624 | 12/1976 | Fed. Rep. of Germany . |
| 2345871 | 5/1977 | Fed. Rep. of Germany . |
| 2510543 | 7/1980 | Fed. Rep. of Germany . |

*Primary Examiner*—Lowell A. Larson

*Attorney, Agent, or Firm*—Herbert Dubno

[57] ABSTRACT

The apparatus for flanging and indenting both ends of a cylindrical container body, particularly for an aerosol or beverage can or container, comprises at least two rotatably driven flanging and indenting heads slidable opposite to each other axially into the container body which are each provided with a radially slidable wobble disk supported centered on a conical member slidable against a spring. Each flanging and indenting head is associaed with a delivery device which brings the flanging and indenting rollers into engagement with the wobble disk. For working a container body composed of doubly reduced or other plate with a Rockwell hardness of at least 60 HR30T each of the wobble disks is associated with two flanging and indenting rollers with parallel rotation axes which are held so that they engage, sometimes simultaneously, the container body to be processed and deform it an increasing amount gradually as seen in the direction of its rotation.

9 Claims, 3 Drawing Sheets

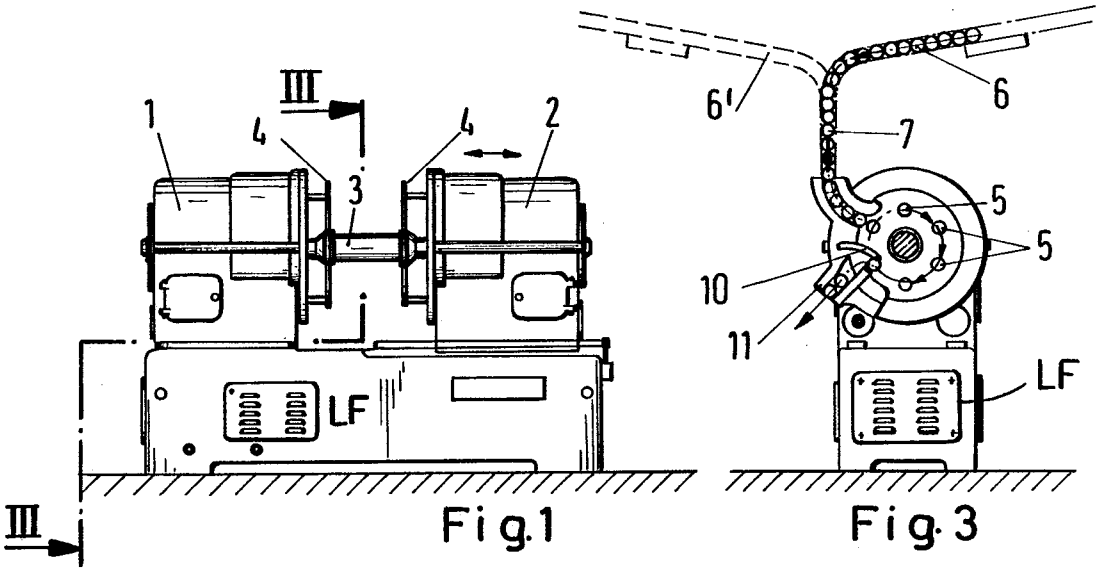
Fig.3
Fig.1
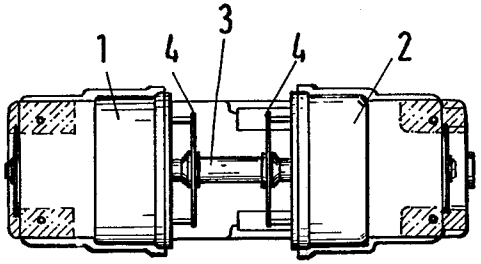
Fig.2

APPARATUS FOR FLANGING AND INDENTING BOTH ENDS OF A CYLINDRICAL CONTAINER BODY

FIELD OF THE INVENTION

My present invention relates to an apparatus for flanging and indenting both ends of a cylindrical container body, especially for an aerosol or beverage can.

BACKGROUND OF THE INVENTION

An apparatus for flanging and indenting both ends of a cylindrical container body, particularly for an aerosol or beverage can, is known in which the flanging and indenting occur in one operation.

This apparatus comprises two rotatably driven flanging and indenting heads slidable opposite to each other axially into the container body which are each provided with a radially slidable wobble disk centered on a conical member slidable against a spring.

Each flanging and indenting head is associated with a pivoting arm equipped with a flanging and indenting roller which is pivotable by at least one controlling cam about an axis running parallel to the rotation axis of the flanging and indenting roller so that the flanging and indenting roller is brought into and out of engagement with the wobble disk to form a flanged and indented edge of the container body.

The above described machine is described in Lanico brochure: "Bördel- und Eiziehautomat BEA 6-325". It is completely automatic and container bodies are fed into it in a horizontal orientation. Several planetlike circular stations with flanging and indenting heads as described above and associated pivoting arms and control cams are provided.

This machine has proved to be extraordinarily successful in practice for processing a cylindrical container body with a longitudinal weld seam. This type of container body is particularly used for making an aerosol or beverage can.

The known machine, however, is only suitable for processing metal sheet which has a sufficient elasticity. With a container body of metal sheet or too great hardness and/or for doubly reduced sheet the flanging and indenting process may not be completed in one operation.

However this sheet even tends to form tears on deformation when several operations are required. On the other hand there is considerable interest in being able to work hard and/or doubly reduced sheet since there are substantial economies derived from its use and the container body can be made with a thinner wall than is used in the conventional process.

OBJECTS OF THE INVENTION

It is an object of my invention to provide an improved apparatus for flanging and indenting both ends of a cylindrical container body which will overcome these drawbacks.

It is also an object of my invention to provide an improved apparatus for flanging and indenting both ends of a cylindrical container body which is suitable for a container body made of comparatively hard as well as comparatively soft sheet metal so that a can with a thinner wall can be provided.

SUMMARY OF THE INVENTION

These objects and others which will become more readily apparent hereinafter are attained in accordance with my invention in an apparatus for flanging and indenting both ends of a cylindrical container body, particularly for an aerosol or beverage can, comprising two rotatably driven flanging and indenting heads slidable opposite to each other axially into the container body which are each provided with a radially slidable wobble disk supported centered on a conical member slidable against a spring.

Each flanging and indenting head is associated with a pivoting arm equipped with a flanging and indenting roller which is pivotable by at least one controlling cam about an axis running parallel to the rotation axis of the flanging and indenting roller so that the flanging and indenting roller is brought into and out of engagement with the wobble disk to form a flanged and indented edge of the container body.

According to my invention for deforming or working the container body composed of doubly reduced metal sheet or another metal sheet with a Rockwell hardness of at least 60 HR30T each wobble disc is associated with two flanging and indenting rollers and the two flanging and indenting rollers are held so as to engage, sometimes simultaneously, on the container body to be processed and deform the container body an increasing amount gradually in the direction of rotation of the container body.

Surprisingly a container body of the above-mentioned metal sheet can be processed by pre- and/or subsequent working of its edges by two flanging and indenting rollers acting simultaneously on the container body and of course within the processing time which is required for the metal sheet used up to now; however tear formation will not occur with the hard and/or doubly reduced metal sheet.

Both flanging and indenting rollers should be positioned following each other on the periphery of the container body as closely as possible as seen in the rotation direction of the container body so that the predeformation caused by one of the rollers is subjected after a short time to the action of the second roller for a subsequent deformation.

For this purpose it is satisfactory when both flanging and indenting rollers associated with each wobble disk are located on the free end of a pivoting arm and at least one of the rollers is held against the wobble disk adjustable relative to the other roller. By adjusting the rollers with respect to each other the relative amount of the pre- and subsequent deformation can be set during each rotation of the container body.

It has proved to be particularly desirable when the roller located closest to the outside in a direction substantially perpendicular to the rotation axes of the rollers on the free end of the pivoting arm is pivotable about the rotation axis of the other roller on the pivoting arm. In this way a sensitive adjustment of the action of one roller relative the other other can be performed.

It has also proved to be particularly advantageous as determined from practical experiments that the roller located closest to the outside in a direction substantially perpendicular to the rotation axes of the rollers on the free end of the pivoting arm be smaller in diameter than the other roller.

In another embodiment of my invention the roller located closest to the outside in the direction substantially perpendicular to the rotation axes of the rollers on the free end of the pivoting arm at least on its peripheral region with which it engages on the container body is smaller than the other roller.

A deformation of the container body before it is exposed to the subsequent action of the larger roller is effected by the smaller roller on the free end of the pivoting arm. Besides the container material springs back after deformation by the first roller. However that is compensated for by the second roller.

BRIEF DESCRIPTION OF THE DRAWING

The above and other objects, features and advantages of my invention will become more readily apparent from the following description, reference being made to the accompanying highly diagrammatic drawing in which:

FIG. 1 is a side elevational view of an apparatus with six planet like circular stations which is used for flanging and indenting a container body according to my invention;

FIG. 2 is a top plan view of the machine shown in FIG. 1;

FIG. 3 is a cross sectional view taken along the section line III—III of FIG. 1 with a feed mechanism indicated diagrammatically;

SPECIFIC DESCRIPTION

Figure 4:
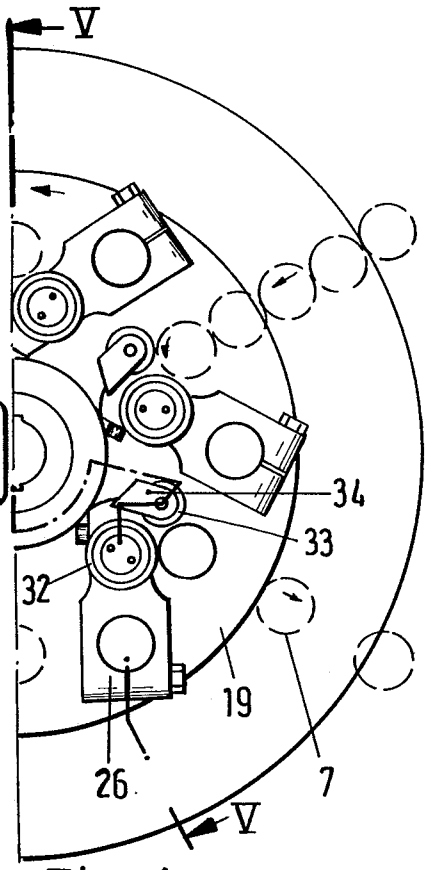
FIG. 4 is a partial front view of a part of the machine according to the example of my invention shown in FIGS. 1 to 3.

The machine shown in FIGS. 1 to 3 comprises two drive units 1 and 2 which are mounted on a lower frame LF and are so controlled by a synchronizing device that they jointly drive a central shaft 3.

Two guide disks 4 are provided held spaced from each other on the central shaft 3 between which the container bodies can be received.

The guide disks 4 have openings for the tools not shown in detail in FIGS. 1 to 3 for flanging and indenting the ends of the container bodies 7.

The machine shown in FIGS. 1 and 2 is equipped according to FIG. 3 with six planetlike circular stations 5 to which the container bodies 7 are fed through the feed channel 6. For the case of a possible interruption of the feed of the containers 7 through the channel 6 an additional feed channel 6' is provided to guarantee the continuous operation of the illustrated machine despite that possibility.

During the rotary motion of the stations 5 the processing of the container bodies 7 takes place. After finishing they are directed by a deflector 10 into an output shaft 11 from which they can be removed in manner not illustrated.

Figure 5:
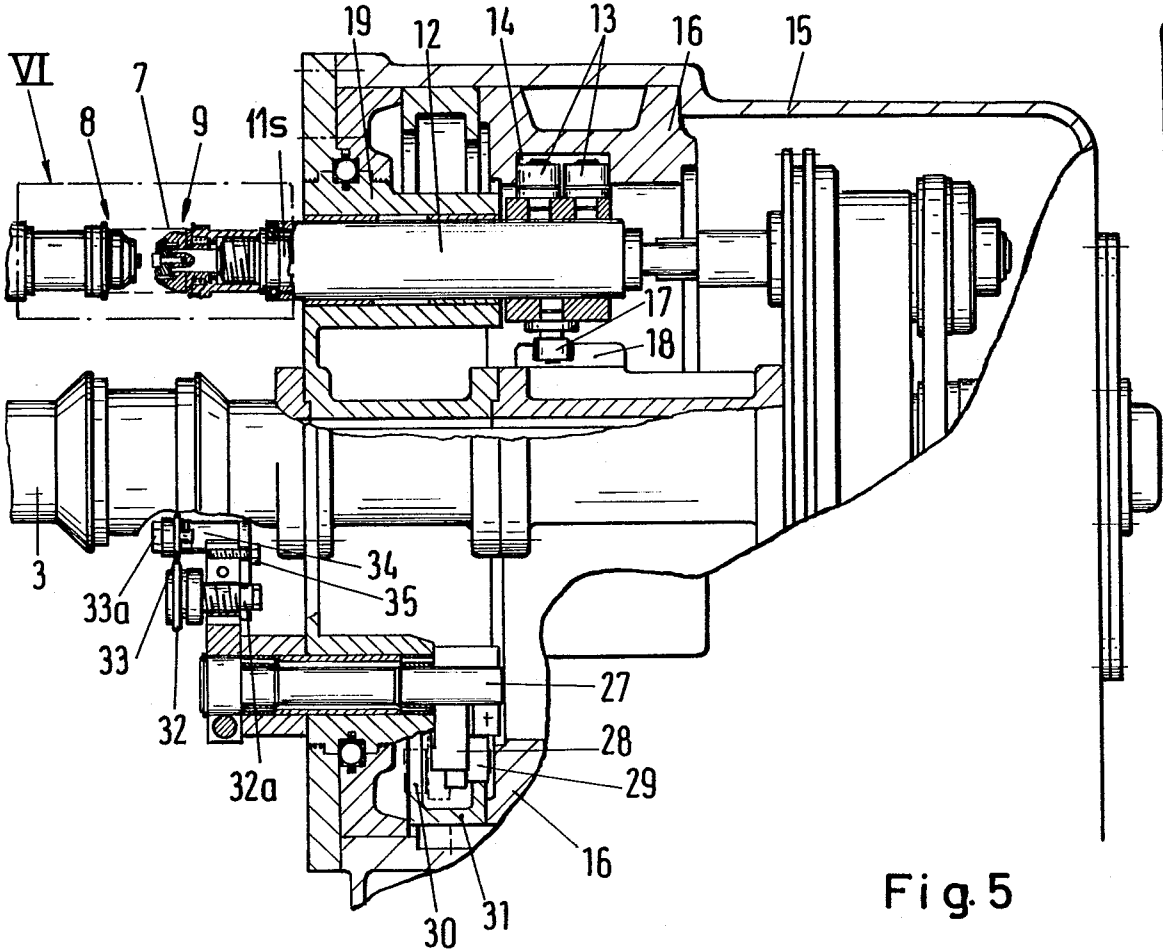
FIG. 5 is a cross sectional view taken along the section line V—V of FIG. 4.
Figure 6:
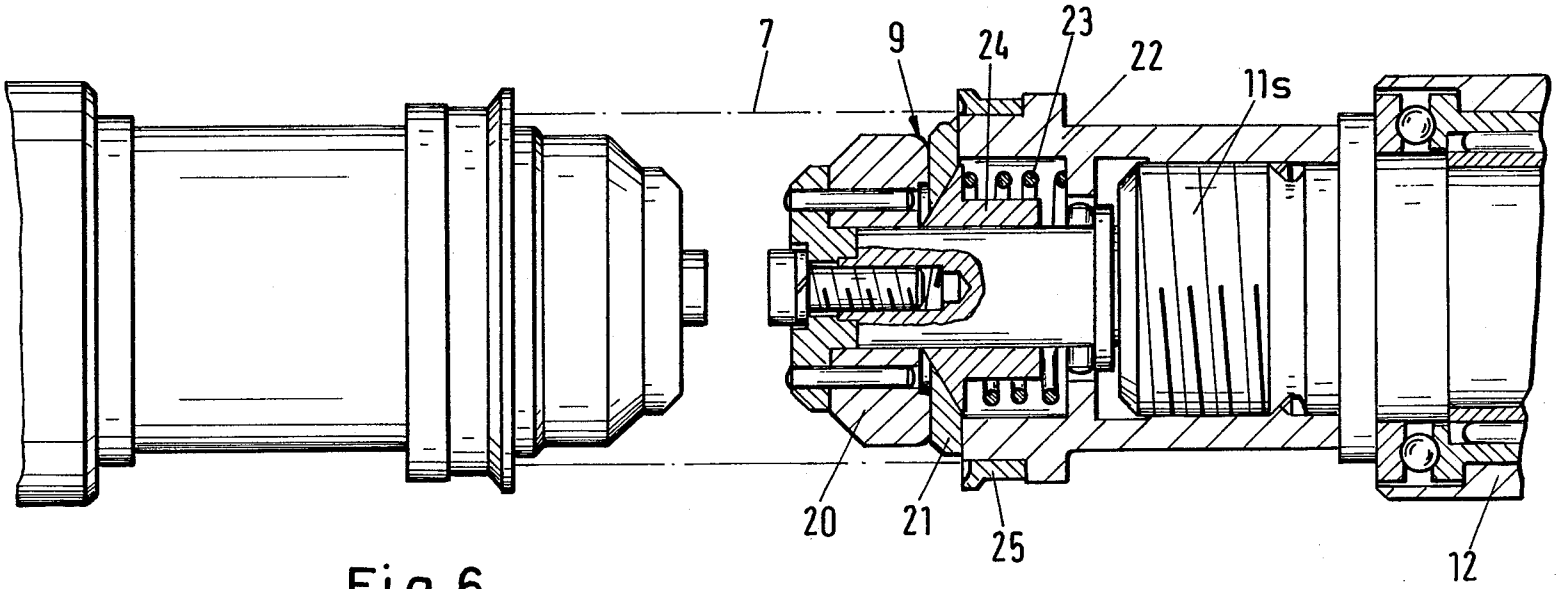
FIG. 6 is an enlarged cross sectional view of the portion VI of FIG. 5.

The structure of the flanging tool of the individual stations 5 and its operation is apparent from FIGS. 4 to 6.

FIGS. 4 to 6 shows that the container bodies 7 are kept at the individual stations 5 by flanging and indenting heads 8 and 9 axially slidable in opposite directions. In FIG. 5 only one of the units 1 and/or 2 is reproduced in a partial cross sectional view since the other drive unit with the tool held in it has the same structure as that shown in FIG. 5.

FIGS. 5 to 6 show that the flanging head 8 and the indenting head 9 is attached with a rotatably driven spindle 11*s*. The spindle 11*s* is held and/or supported for its part in a sliding sleeve 12. Slider rollers 13 are attached nonrotatably with the sliding sleeve 12 which engages in a groove 14 of a locally fixed circular member 16 held in the housing 15. Further a guide roller 17 connected with the slider sleeve 12 is rigidly mounted. It cooperates or acts together with the guide strip 18 rotating with the central shaft 3.

The sliding sleeve 12 is held in a circular supporting piece 19 attached with the central shaft 3.

The structure of the flanging and indenting head 9 is shown in detail in the magnified illustration in FIG. 6.

Opposing disks 20, cooperating with the flanging and/or indenting roller, are nonrotatably mounted on the spindles 11s on their free ends. A wobble ring 21 bears on the opposing disk 20 and is held with play between the opposing disk 20 and a sleeve 22 rotating with the spindle 11*s*. The wobble ring 21 acts together or cooperates with a conical member 24 held axially slidable against a spring 23 on the spindle 11*s*. Also a side wall jacket 25 in the form of a circular structural member is held on the sleeve 22.

During the flanging process one end of a container body 7 is pressed and deformed against the wobble disk 21 by the flanging roller still to be described. The edges of the opening of the container body 7 cooperate with the side wall jacket 25 which stabilizes the container body 7 held in position between both flanging and indenting heads 8 and 9.

The wobble disk 21 is pushed radially under the action of the flanging roller and causes for its part an axial sliding of the conical member 24 under the compression pressure of the spring 23.

The sliding of the wobble disk 21 occurs to such an extent that an indented flange edge arises in the region between the opposing disk 20 and the wobble disk 21. On moving the flanged roller back the wobble disk 21 is moved by the action of the spring 23 and the conical member 24 again into the position illustrated in FIG. 6, before the release of the container body 7 flanged in this way occurs.

Each flanging and indenting head 8 and/or 9 is associated with a pivoting arm 26 held on the circular shaped supporting member 19 which is attached nonrotatably with a pivot axle 27 which for its part cooperates with a controlling cam 31 by an arm 28 and cam rollers 29 and 30 held rotatably on it. The controlling cam 31 is held nonrotatably on the circular component 16.

On the free end of the pivoting arm 26 two flanging and indenting rollers 32 and 33 with parallel rotation axes are provided according to my invention. Thus the flanging and indenting roller 33 is held pivotable with respect to the flanging and indenting roller 32. For that purpose the flanging and indenting roller 33 is mounted on a supporting arm 34 which is pivotally mounted but is held at each angular position rigidly with respect to the pivoting arm 26.

From FIG. 5 the parallel orientation of the rotation axes 32*a* and 33*a* of the flanging and indenting rollers 32 and 33 is particularly apparent. FIG. 5 shows the mounting screws 35 for the supporting arm 34.

The roller 33 located on the outside on the pivoting arm 26 is kept smaller in diameter in this example than the roller 32. It has moreover a reduced thickness compared with the roller 32.

From FIG. 4 one learns that the roller 32 and 33 simultaneously engage on a container body 7 and that with the indicated rotational motion of the container body 7 in the motion direction of the container body 7 the smaller roller 33 and then the roller 32 which is larger in diameter and wider engages on the container body.

The form of the flanging and indenting heads 8 and 9 described for a station 5 with associated operating mechanism and the flanging and indenting rollers 32 and 33 with associated pivoting arm 26 are formed identically at all stations of the illustrated machine.

With such flanging devices it is possible to work or process container bodies from doubly reduced metal sheet or other metal sheet with a Rockwell hardness of 60 HR 30T and harder to indent and to flange the edges of the container body. Otherwise tear formation is likely to occur.

Instead of the pivoting arm carrying the flanging and indenting rollers also the known roller can be provided with another preparing or delivery device movable in the direction of the wobble disk 21.

I claim:

1. In an apparatus for flanging and indenting an end of a cylindrical container body, particularly for an aerosol or beverage container, comprising at least two rotatably driven slidable opposite to each other axially into said container body to support said body, at least one of said heads being a flanging and indenting head provided with a radially slidable wobble disk supported centered on a conical member slidable against a spring, said flanging and indenting head being provided with a pivoting arm equipped with a flanging and indenting roller which is pivotable by at least one controlling cam about an axis running parallel to the rotation axis of said flanging and indenting roller so that said flanging and indenting roller is brought into and out of engagement with said wobble disk to form a flanged and indented edge of said container body, the improvement wherein for deforming or working said container body composed of doubly reduced or other metal sheet with a Rockwell hardness of at least 60 HR30T, said wobble disk is associated with two of said flanging and indenting rollers and said two flanging and indenting rollers are held so as to engage on said container body to be processed and deform said container body by increasing amounts gradually in the direction of rotation of said container body, two flanging and indenting rollers associated with said wobble disk being positioned jointly on the free end of said pivoting arm and at least one of said flanging and indenting rollers is angularly adjustable on said free end of said arm relative to the other of said flanging and indenting rollers for successive engagement of said flanging and indenting rollers with said container body.

2. The improvement according to claim 1 wherein said flanging and indenting roller located closest to the outside in a direction substantially perpendicular to said rotation axis on said free end of said pivoting arm is held on said pivoting arm so as to be pivotable about said rotation axis of the other one of said flanging and indenting rollers.

3. The improvement according to claim 1 wherein said flanging and indenting roller located closest to the outside in a direction substantially perpendicular to said rotation axis on said free end of said pivoting arm is smaller in diameter than the other of said flanging and indenting rollers.

4. The improvement according to claim 1 wherein said flange and indenting roller located closest to the outside in a direction substantially perpendicular to said rotation axis on said free end of said pivoting arm at least in the peripheral region with which said roller engages on said container body is smaller than said other roller.

5. An apparatus for flanging and indenting both ends of a cylindrical container body, comprising:

a housing having two drive units;

a shaft synchronously driven by said two drive units and rotatable about an axis of rotation;

guiding means spaced apart on and coaxial with said shaft for holding a plurality of cylindrical container bodies to be indented, each of said guiding means being formed with a plurality of planetlike stations, each of said stations being fed with a respective cylindrical container body to be indented and comprising:

two flanging and indenting heads spaced from and coaxial with one another, said two heads being rotatable about a respective sliding axis parallel to said axis of rotation, at least one of said heads being slidable opposite to the other along the sliding axis, each of said heads comprising:

a frustoconical disk at an end of said intending head facing the opposite head, a conical member coaxial with said frustoconical disk and axially slidably against an axially yieldable retaining member, said conical member having a conical surface tapering toward said frustoconical disk, and a wobble disk radially slidable between said frustoconical disk and the respective conical member bearing on said conical surface of said conical member so that said wobble disk and said frustoconical disk form an indenting region;

two flanging and indenting rollers rotatable about respective roller axes parallel to said axis of rotation and located jointly on a free end of a respective arm, said rollers being angularly adjustable relative to one another, juxtaposed with the respective wobble disk and successively engaging the respective cylindrical container body to be indented; and cam means for controlling the successive engagement of each of said indenting rollers in the respective container body to be indented, said cam means having a cam shaft rotatable about a cam axis parallel to said axis of rotation and carrying the respective arm, said arm being pivotal about and being attached perpendicular and nonrotatably to said shaft with an end spaced from said free end of the respective arm, said cam means bringing said arm toward the respective container body, so that said one of said rollers contacts the respective cylindrical container body to be indented and drives radially the respective wobble disk to initially indent said body and then the lower roller subsequently extends the deformation made by the upper roller.

6. The apparatus defined in claim 5 wherein said other of said rollers has a diameter and thickness larger those of said one roller.

7. The apparatus defined in claim 5 wherein said one roller is pivotal about the roller axis of rotation of the respective lower roller.

8. The apparatus defined in claim 5 wherein each of said indenting heads, further comprises a sleeve coaxial with the respective frustoconical disk, said sleeve extending axially at a distance from the respective frustoconical disk and being formed with a supporting wall jacket radially extending over a periphery of said sleeve, said sleeve having a surface facing said frustoconical disk, so that said supporting wall jacket and said surface form an abutment for a respective edge of the cylindrical container to be flanged.

9. A method of indenting and flanging a container body composed of a metal sheet with a Rockwell hardness of at least 60 HR30T in an apparatus having a frame with two driving units mounted on said frame synchronously driving a shaft with guiding means spaced apart on said shaft, said guiding means being formed with a plurality of mutually aligned pairs of planetlike stations, comprising the steps of:

feeding a container body into a respective pair of planetlike stations each comprising two flanging and indenting heads coaxial with one another, each of said heads having a radially movable wobble disk and a sleeve coaxial with said wobble disk of the respective head;

sliding at least one of said flanging heads oppositely the other till at least one end of the respective container body is pressed against the sleeve of the respective head radially extending over a periphery of said container body so that said body is stabilized between the respective heads;

pushing an upper indenting roller toward said container body till said upper indenting roller is in contact with said container body;

rotating said container body, so that said upper roller continuously indents said body at with radial shifting of the respective wobble disk; and pressing a respective lower roller against said container body to further shift the wobble disk and extend the indentation in said body.

* * * * *